United States Patent [19]

Stolfa

[11] 4,058,451

[45] Nov. 15, 1977

[54] COMBINATION PROCESS FOR PRODUCING HIGH QUALITY METALLURGICAL COKE

[75] Inventor: Frank Stolfa, Park Ridge, Ill.

[73] Assignee: UOP Inc., Des Plaines, Ill.

[21] Appl. No.: 716,736

[22] Filed: Aug. 23, 1976

[51] Int. Cl.[2] ..... C10G 9/14; C10G 37/06

[52] U.S. Cl. ..... 208/97; 208/131

[58] Field of Search ..... 208/46, 97, 106, 131

[56] References Cited

U.S. PATENT DOCUMENTS

| | | | |
|---|---|---|---|
| 2,789,085 | 4/1957 | Rollman | 208/97 |
| 2,793,172 | 5/1957 | Smith et al. | 208/97 |
| 2,901,417 | 8/1959 | Cook et al. | 208/97 |
| 3,369,992 | 2/1968 | Henke et al. | 208/131 |
| 3,475,323 | 10/1969 | Stuckey et al. | 208/97 |
| 3,707,462 | 12/1972 | Moss | 208/127 |

*Primary Examiner*—Herbert Levine
*Attorney, Agent, or Firm*—James R. Hoatson, Jr.; Thomas K. McBride; William H. Page, II

[57] ABSTRACT

A process for producing high quality metallurgical coke from hydrocarbonaceous charge stock containing coke precursors which comprises: (a) admixing said hydrocarbonaceous charge with a hereinafter described hydrocarbonaceous recycle stream; (b) introducing the resulting admixture into a coking zone maintained at coking conditions to produce coke and a hydrocarbonaceous effluent having a reduced level of coke precursors; (c) introducing at least a portion of said hydrocarbonaceous effluent into a hydrodesulfurization zone maintained at hydrodesulfurization conditions; (d) recycling at least a portion of the resultant desulfurized hydrocarbon of step (c) to step (a) as said hydrocarbonaceous recycle stream.

3 Claims, 1 Drawing Figure

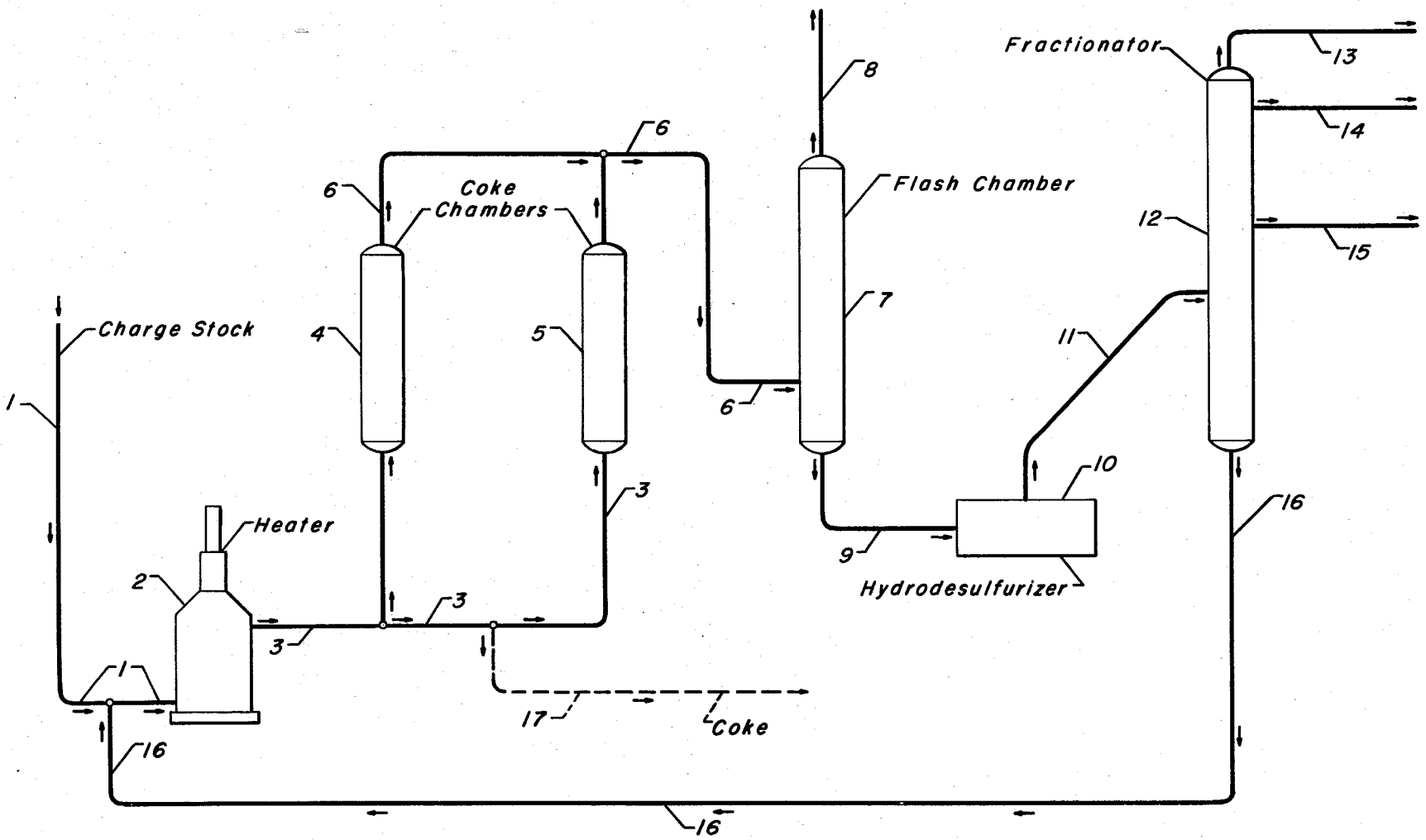
Fractionator
Flash Chamber
Hydrodesulfurizer
Coke Chambers
Heater
Charge Stock
Coke
1
2
3
4
5
6
7
8
9
10
11
12
13
14
15
16
17

COMBINATION PROCESS FOR PRODUCING HIGH QUALITY METALLURGICAL COKE

BACKGROUND OF THE INVENTION

Coke derived from hydrocarbonaceous charge stocks and used for metallurgical purposes are priced inversely proportional to the sulfur content thereof. In some applications of metallurgical coke, acceptable sulfur levels are as low as 2 wt. % or even less. The sulfur contained in hydrocarbonaceous charge stocks utilized as coke precursors increases as the molecular weight of the hydrocarbon fraction increases. If the reduced crude from a typical Prudhoe Bay crude oil was coked in a low pressure coker, the sulfur level in the resulting coke would be about 2.8 wt. % which is unsatisfactory for metallurgical coke.

I have discovered that if a high recycle rate of desulfurized coker effluent is utilized, the yield of coke is increased and the sulfur in a Prudhoe coke, for example, would be reduced to at least 1.8 wt. %. The lower sulfur content would result because a greater portion of the coke would be derived from the lower molecular weight, lower sulfur gas oil boiling range fraction. According to the method of my invention, a high quality metallurgical coke may be prepared from high sulfur containing hydrocarbonaceous charge stocks.

SUMMARY OF THE INVENTION

Accordingly, it is an object of this invention to provide a method for producing high quality metallurgical coke from sulfur-containing hydrocarbonaceous charge stocks.

Therefore, the practice of the present invention provides a process for producing high quality metallurgical coke from hydrocarbonaceous charge stock containing coke precursors which comprises: (a) admixing said hydrocarbonaceous charge with a hereinafter described hydrocarbonaceous recycle stream; (b) introducing the resulting admixture into a coking zone maintained at coking conditions to produce coke and a hydrocarbonaceous effluent having a reduced level of coke precursors; (c) introducing at least a portion of said hydrocarbonaceous effluent into a hydrodesulfurization zone maintained at hydrodesulfurization conditions; (d) recycling at least a portion of the resultant desulfurized hydrocarbon of step (c) to step (a) as said hydrocarbonaceous recycle stream.

DESCRIPTION OF THE DRAWING

In further describing the present invention, reference will be made to the accompanying drawing which is presented for the sole purpose of illustration and not of limitation. Thus, miscellaneous appurtenances, including valves, controls, instruments, compressure, pumps, heat exchangers, start-up lines, heat recovery circuits, etc. have been eliminated. The use of this type of conventional hardware is well within the purview of those skilled in the techniques of petroleum refining processing techniques.

The drawing is representative of a simplified schematic flow diagram.

With reference now to the drawing, the hydrocarbonaceous charge stock is introduced through line 1 into heater 2 together with a desulfurized hydrocarbonaceous recycle stream transported via line 16. The temperature is raised to a suitable coking temperature selected from the range of about 875° F. to about 975° F.

depending on the composition of the charge stock. The heated admixture of charge stock and recycle is passed by way of line 3 into coke chambers 4 and 5 maintained at a suitable coking pressure selected from the range of about 20 psig. to about 75 psig. Coke is recovered from coke chambers 4 and 5 via line 17. A hydrocarbonaceous effluent having a reduced level of coke precursors is passed from coke chambers 4 and 5 via line 6 into flash chamber 7. Hydrocarbons boiling up to a temperature of about 400° F. are removed from flash chamber 7 via line 8. Hydrocarbons boiling at a temperature greater than about 400° F. are passed from flash chamber 7 via line 9 into hydrodesulfurizer 10. Hydrodesulfurizer conditions include a pressure from about 500 psig. to about 1200 psig. and a temperature from about 600° F. to about 800° F. The resulting hydrodesulfurized hydrocarbons are passed from hydrodesulfurizer 10 via line 11 into fractionator 12. Fractionator 12 is maintained under suitable conditions to separate distillate hydrocarbons boiling up to about 650° F. which are withdrawn via lines 13, 14 and 15. A bottoms material is passed from fractionator 12 via line 16 to line 1 as the desulfurized hydrocarbonaceous recycle stream.

The foregoing illustrates the method by which my invention is practiced. Other advantages and benefits will become apparent to those skilled in the art.

The following example is cited to illustrate the results obtainable in one specific adaption of the invention, but is not to be construed as limiting in scope.

EXAMPLE

A coking unit similar to that illustrated in the drawing is utilized according to the method of my invention to produce 78,256 lbs. of coke per day containing 1.87 wt. % sulfur. A fresh feed in the amount of 27,047 barrels per day of a 680° F.+ reduced crude with a gravity of 15.4° API and a sulfur content of 1.5 wt. % is admixed with a desulfurized recycle stream in an amount of 27,047 barrels per day containing 0.1 wt. % sulfur. The admixture is heated to a temperature of about 925° F. and introduced into a coke chamber maintained at a pressure of about 60 psig. The coke chamber effluent is then introduced into a primary flash chamber in order to recover a $C_4$-minus stream plus hydrogen sulfide at a rate of 45,519 lbs./hr., a $C_5$ to 400° F. stream at a rate of 97,964 lbs./hr. and 400° F.-plus stream at a rate of 520,202 lbs./hr. The 400° F.-plus stream is then processed in a hydrodesulfurizer containing a cobalt-molybdenum catalyst at a temperature of 650° F. and a pressure of 1000 psig. The desulfurizer effluent is fractionated to recover a $C_4$-minus stream plus hydrogen sulfide and ammonia at a rate of 3952 lbs./hr., a $C_5$ to 400° F. stream at a rate of 2600 lbs./hr., a 400° F. to 650° F. stream at a rate of 152,458 lbs./hr. and 650° F.-plus stream at a rate of 363,262 lbs./hr. which stream comprises the desulfurized recycle stream.

The foregoing specification and example clearly illustrate the improvements encompassed by the present invention and the benefits to be afforded a process for the production of high quality coke performed according to the method of the present invention.

I claim as my invention:

1. A process for producing high quality metallurgical coke from a sulfur-containing reduced crude oil which comprises:

a. admixing said reduced crude oil with a hydrocarbon recycle stream formed as hereinafter set forth;

b. introducing the resulting mixture into a coking zone maintained at coking conditions to produce coke and a hydrocarbon effluent having a reduced level of coke precursors;

c. separating the coke from the hydrocarbon effluent and recovering the same;

d. introducing the hydrocarbon effluent to a flash zone and therein vaporizing hydrocarbons boiling up to about 400° F.;

e. hydrodesulfurizing the remainder of said effluent boiling above about 400° F.;

f. fractionating the resultant desulfurized remainder of the hydrocarbon effluent to separate therefrom hydrocarbons boiling up to about 650° F., leaving a desulfurized hydrocarbon bottoms fraction boiling above about 650° F.; and g. supplying at least a portion of said desulfurized bottoms fraction boiling above about 650° F., to step (a) as said hydrocarbon recycle stream for admixture with the reduced crude oil therein.

2. The process of claim 1 further characterized in that said coking conditions include a pressure from about 20 psig. to about 75 psig. and a temperature from about 875° F. to about 975° F.

3. The process of claim 1 further characterized in that said hydrodesulfurization is effected at a pressure from about 500 psig. to about 1200 psig., and a temperature from about 600° F. to about 800° F.

* * * * *